United States Patent [19]

Dalheimer et al.

[11] 4,294,039

[45] Oct. 13, 1981

[54] PIVOTAL CONNECTION FOR HOODS AND COVERS IN MOTOR VEHICLES

[75] Inventors: Walter Dalheimer; Olaf Kuus, both of Sindelfingen, Fed. Rep. of Germany

[73] Assignee: Daimler-Benz Aktiengesellschaft, Stuttgart, Fed. Rep. of Germany

[21] Appl. No.: 72,912

[22] Filed: Sep. 6, 1979

[30] Foreign Application Priority Data

Sep. 21, 1978 [DE] Fed. Rep. of Germany ..... 2841092

[51] Int. Cl.[3] ..... E05D 15/40

[52] U.S. Cl. ..... 49/248; 296/76

[58] Field of Search ..... 49/248, 249, 246; 180/69 R, 69 C; 296/76

[56] References Cited

U.S. PATENT DOCUMENTS

| | | | |
|---|---|---|---|
| 2,784,459 | 3/1957 | Anderberg et al. | 49/248 |
| 3,101,135 | 8/1963 | Neal et al. | 49/248 |
| 3,234,584 | 2/1966 | Valade | 296/76 X |
| 3,345,777 | 10/1967 | Anderberg et al. | 49/248 |
| 3,643,755 | 2/1972 | Gionet et al. | 296/76 X |

*Primary Examiner*—Philip C. Kannan

*Attorney, Agent, or Firm*—Craig and Antonelli

[57] ABSTRACT

A pivotal connection for hoods or covers of motor vehicles which includes a lever arrangement extending between a bracket which is integral with the vehicle and the hood or cover. A control device is provided for controlling a positioning of an edge of the hood or cover which is nearest to a pivot axis of the pivotal connection with a spring being provided for supporting a movement of the hood or cover into an open position. The lever arrangement includes a support arm rotatably mounted on a bracket with the support arm being connected with a track supporting the hood or cover. A link and two arm guide lever are provided so as to form with the track and support arm a four-bar linkage which undergoes a reversal in the course of a pivoting movement of the hood or cover by way of a lever articulated at a free end of the two armed guide lever as well as on the bracket.

8 Claims, 3 Drawing Figures

PIVOTAL CONNECTION FOR HOODS AND COVERS IN MOTOR VEHICLES

The present invention relates to a connection arrangement and, more particularly, to a pivotal connection for hoods or covers of motor vehicles which includes a lever arrangement extending between a bracket integrally formed with the vehicle and the hood or cover and with a control arrangement for controlling the displacement of an edge of the hood or cover nearest to the pivot axis with a spring means being provided for reinforcing the movement of the hood or cover.

A pivotal connection of the aforementioned type is proposed in, for example, German Pat. No. 873,949; however, a disadvantage of the proposed pivotal connection resides in the fact that it requires a relatively large amount of space which is consequently lost as space for other installations and/or storage. Additionally, the opening angle in the proposed construction is rather small so that accessibility to the space to be enclosed such as, for example, the engine compartment or the like is restricted.

The aim underlying the present invention essentially resides in providing a pivotal connection for a hood or cover which can be accomodated in a small installation space and which enables the cover or hood to be displaced or transferred from a closed to an open position at which open position there is good accessibility to, for example, the engine compartment and/or the luggage compartment.

In accordance with the present invention, the lever arrangement includes a support arm rotatably mounted on the bracket with the support arm being connected with the hood or cover directly or by way of a track supporting the hood or cover to produce the control device. A bracket in a two armed lever is interposed between the support arm and the track so as to result in the formation of a four bar linkage having the shape of a parallelogram which linkage undergoes a reversal during the course of a pivoting or swiveling action by means of a lever articulated in a free end of the two-armed guide lever and at the bracket.

In accordance with the present invention, the support arm may be extended beyond its articulation point on the bracket so as to accommodate one end of the spring with the other end of the spring being attached in a vicinity of an upper pivot or articulation point of the guide lever to the hood or cover or to the track.

Accordingly, it is an object of the present invention to provide a pivotal connection for motor vehicle hoods or covers which avoids, by simple means, shortcomings and disadvantages encountered in the prior art.

Another object of the present invention resides in providing a pivotal connection for hoods or covers of motor vehicles which enables the hoods or covers to be displaced into a relatively wide opening angle so as to maximize accessibility to the space enclosed by the hood or cover.

These and other objects, features, and advantages of the present invention will become more apparent from the following description when taken in connection with the accompanying drawings which show, for the purposes of illustration only, one embodiment in accordance with the present invention, and wherein.

Figure 1:
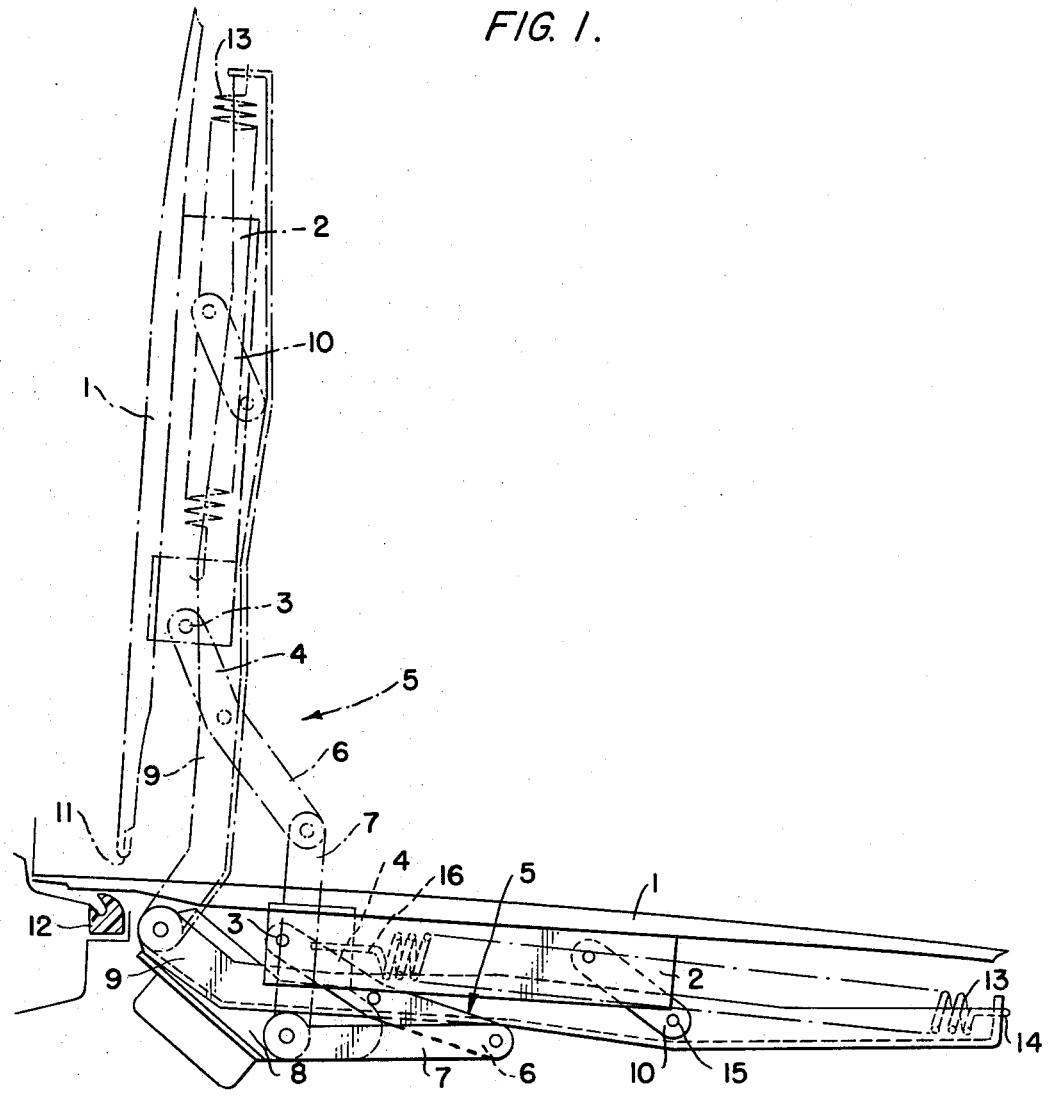
FIG. 1 is a partially schematic longitudinal view of a pivotal connection for a motor vehicle hood or cover in accordance with the present invention with the solid lines depicting the hood or cover in a closed position and the dot-dashed lines depicting the cover or hood in an open position.
Figure 2:
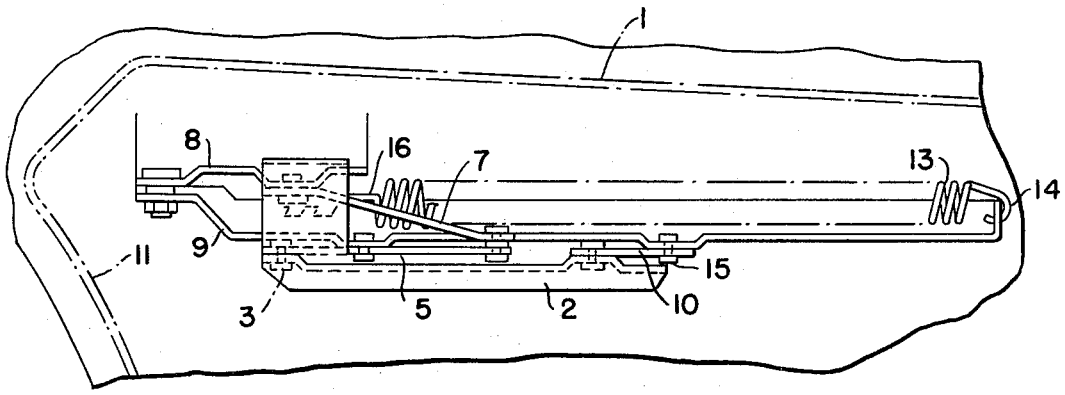
FIG. 2 is a top view of the pivotal connection of FIG. 1 with the hood or cover in a closed position.
Figure 3:
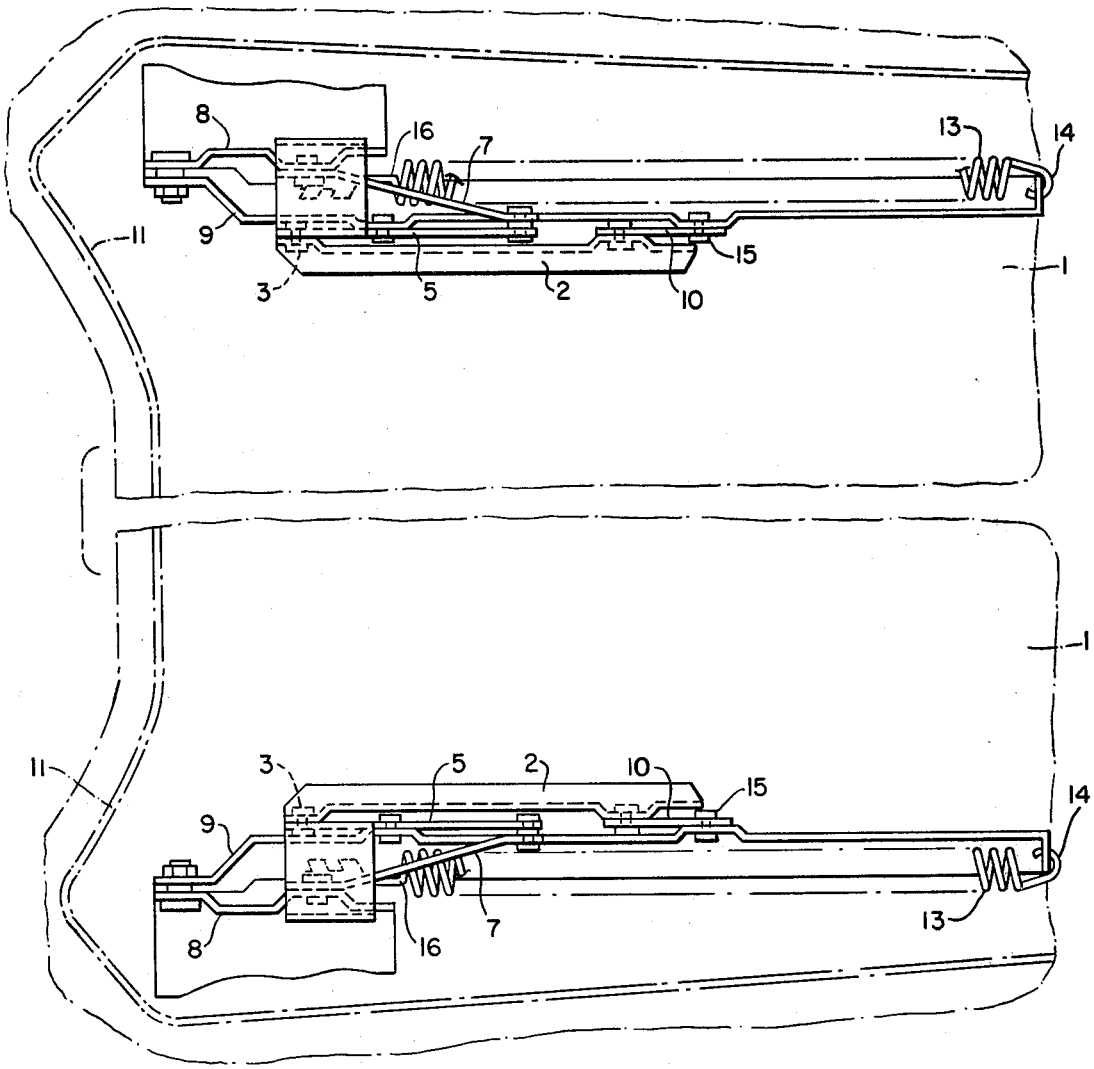
FIG. 3 is a top view of the pivotal connection of FIG. 1 arranged at respective lateral sides of the hood or cover, with the hood or cover in a closed position.

Referring now to the drawings wherein like reference numerals are used in both views to designate like parts and, more particularly, to FIG. 1, according to this figure, a hood or cover 1 of a motor vehicle (not shown) has disposed on an underside thereof two spaced tracks 2, each of which, as shown most clearly in FIG. 3, is arranged, for example, at respective lateral sides of the hood or cover 1. The two spaced tracks 2 serve particularly for reinforcement of the hood or cover 1.

Each of the tracks 2 are respectively pivotally connected at a pivot point 3 to a free end 4 of a two armed guide lever 5. The other free end 6 of the two armed guide lever 5 is connected by a lever 7 to a bracket 8 which is integrally formed with the body of the vehicle.

The two armed guide lever 5 is mounted on a support arm 9 articulated to the bracket 8. A bracket or link 10 has a first end pivoted at 15 to a support arm 9 and a second end pivoted to the associated track 2. The bracket 10, track 2, free end of the two armed guide lever 5, and a section of the support arm 9 which is located between the guide lever 5 and link or bracket 10 forms a four-bar linkage in the shape of a parallelogram which linkage undergoes a reversal by way of the free end 6 of the guide lever 5 in cooperation with the lever 7 as the cover or hood 1 is opened or swung upward whereby an edge 11 of the cover or hood 1 nearest to the pivot axis is first raised and then moved past a sealing gasket 12.

A spring 13 is provided for supporting or reinforcing the movement of the hood or cover 1 with one end 14 of the spring 13 being connected to the support arm 9. The spring 13 is extended beyond the pivot point of the bracket 10 with the other end 16 of the spring 13 being mounted on the track 2 in the vicinity of the upper articulation or pivot point 3 of the guide lever 5.

While we have shown and described only one embodiment in accordance with the present invention, it is understood that the same is not limited thereto but is susceptible of numerous changes and modifications as known to one having ordinary skill in the art and we therefore do not wish to be limited to the details shown and described herein but intend to cover all such modifications as are encompassed by the scope of the appended claims.

We claim:

1. A pivotal connection for hoods or covers of motor vehicles which includes a lever means arranged between a bracket formed on the vehicle and the hood or cover, and a control means for controlling a positioning of an edge of the hood or cover which is nearest the pivot axis of the pivotal connection, characterized in that a track means is provided for supporting the hood or cover, the lever means includes a support arm having a first end rotatably mounted on the bracket and a second end connected with the track means, a two-armed guide lever means is pivotally mounted on the support arm and has a first arm a free end thereof which is pivotally connected to the track means, and a link means having a first end pivotally connected to the support arm and a second end pivotally connected to the track means at a position spaced from the pivotal connection of the first arm with the track means, the first arm, the track means, the link means, and a section of the support arm located between the first arm and the link means forming a four-bar linkage, and in that the control means includes a lever having a first end pivotally mounted at a free end of a second arm of the guide lever means and a second end pivotally connected to the bracket whereby, upon an opening of the hood or cover, the four-bar linkage undergoes a reversal such that an edge of the hood or cover nearest the pivot axis of the pivotal connection is first raised upwardly.

2. A pivotal connection according to claim 1, characterized in that a spring means is arranged between the support arm and the track means for supporting an opening movement of the hood or cover.

3. A pivotal connection according to claim 2, characterized in that the support arm includes a portion extending beyond the pivotal connection of the link means thereto, and in that one end of the spring means is connected to said extending portion of the support arm and the other end of the spring means is attached to the track means in an area of the pivotal connection of the first arm to the track means.

4. A pivotal connection according to claims 1, 2, or 3, characterized in that the four-bar linkage has the shape of a parallelogram.

5. A pivotal connection according to one of claims 1 or 2, characterized in that a pair of support arms and track means are provided at respective lateral sides of the hood or cover, a two armed guide lever means is rotatably mounted on the respective support arms, a free end of a first arm of the guide lever means is pivotally connected to the associated track means, a pair of link means are provided with a first end of the respective link means being pivotally connected to the respective support arm at a position spaced from the pivotal connection of the first arm with the track means, the first arm, the track means, the link means, and a section of the respective support arms located between the first arm and link means forming a four-bar linkage at respective lateral sides of the hood or cover, and in that the control means includes a pair of levers each having a first end pivotally mounted at a free end of a second arm of the respective guide lever means and a second end pivotally mounted to a bracket disposed at respective lateral sides of the vehicle.

6. A pivotal connection according to claim 5, characterized in that spring means are arranged between each support arm and associated track means.

7. A pivotal connection according to claim 5, characterized in that each support arm includes a portion extending beyond the pivotal connection of the link means thereto, and in that one end of the respective spring means is connected to said extending portion of the support arm and the other end of the spring means is attached to the track means in an area of the pivotal connection of the respective first arms to the track means.

8. A pivotal connection according to claim 7, characterized in that each four-bar linkage has the shape of a parallelogram.

* * * * *